US010113802B2

(12) United States Patent
Steinbauer et al.

(10) Patent No.: US 10,113,802 B2
(45) Date of Patent: Oct. 30, 2018

(54) SPIRAL WOUND HEAT EXCHANGER SYSTEM WITH CENTRAL PIPE FEEDER

(71) Applicant: LINDE AKTIENGESELLSCHAFT, Munich (DE)

(72) Inventors: Manfred Steinbauer, Raisting (DE); Helmut Reithmeier, Poing (DE); Christiane Kerber, Pocking (DE); Markus Hammerdinger, Tacherting (DE); Jurgen Spreemann, Rosenheim (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 627 days.

(21) Appl. No.: 14/315,875

(22) Filed: Jun. 26, 2014

(65) Prior Publication Data

US 2015/0000873 A1 Jan. 1, 2015

(30) Foreign Application Priority Data

Jun. 27, 2013 (EP) ..... 13003276

(51) Int. Cl.
*F28D 1/06* (2006.01)
*F25J 5/00* (2006.01)
(Continued)

(52) U.S. Cl.
CPC ..... *F28D 1/06* (2013.01); *F25J 5/002* (2013.01); *F28D 7/024* (2013.01); *F28D 15/00* (2013.01);
(Continued)

(58) Field of Classification Search
CPC . F28D 1/06; F28D 15/00; F28D 7/024; F28D 2021/0033; F28F 9/00; F28F 9/026; F28F 2265/18; F25J 5/0002; F25J 2290/32
(Continued)

(56) References Cited

U.S. PATENT DOCUMENTS 3,158,010 A * 11/1964 Kuerston ..... F25J 3/0209 165/145
6,613,281 B2 * 9/2003 Filho ..... A61M 1/1698 165/163
(Continued)

FOREIGN PATENT DOCUMENTS

DE 102004040974 A1 3/2006
EP 2511642 A2 10/2012
WO 2008/009357 A1 1/2008

OTHER PUBLICATIONS

Search Report dated Nov. 20, 2013 issued in corresponding EP 13003276 application (pp. 1-2).

*Primary Examiner* — Raheena R Malik
(74) *Attorney, Agent, or Firm* — Miller, White, Zelano, Branigan, P.C.

(57) ABSTRACT

The invention relates to a heat exchanger system comprising a jacket extending along a longitudinal axis and surrounding a jacket space. A pipe bundle is arranged in the jacket space wherein pipes are wound helically around a central pipe. At least one pre-distributor container is arranged in the jacket space for accommodating and degassing a liquid-gas mixture and designed to coat a distributing means with liquid degassed in the at least one pre-distributor container. The distributing means is designed to deliver the liquid to the pipe bundle. At the top the jacket has an inlet which is aligned with the longitudinal axis and in fluid connection with the central pipe. The central pipe has at least one lateral opening so that the liquid-gas mixture can be fed via the inlet, the central pipe, and the at least one lateral opening into the at least one pre-distributor container.

19 Claims, 2 Drawing Sheets

(51) Int. Cl.

| | |
|---|---|
| ***F28F 9/02*** | (2006.01) |
| ***F28D 7/02*** | (2006.01) |
| ***F28D 15/00*** | (2006.01) |
| ***F28F 9/00*** | (2006.01) |
| *F28D 21/00* | (2006.01) |

(52) U.S. Cl.
CPC ..... *F28F 9/00* (2013.01); *F28F 9/026* (2013.01); *F25J 2290/32* (2013.01); *F28D 2021/0033* (2013.01); *F28F 2265/18* (2013.01)

(58) Field of Classification Search
USPC ..... 165/157, 115, 163, 104.21
See application file for complete search history.

(56) References Cited

U.S. PATENT DOCUMENTS 7,607,471 B2 * 10/2009 Saika ..... F28F 27/00 165/155
8,051,901 B2 11/2011 Schonberger et al.
8,087,454 B2 1/2012 Kerber et al.
8,721,975 B2 * 5/2014 Filippi ..... B01J 19/0013 165/157
2002/0020516 A1 * 2/2002 Wisniewski ..... F25D 31/006 165/61
2007/0169924 A1 * 7/2007 Bussonnet ..... F28D 9/0006 165/157
2008/0041572 A1 * 2/2008 Wessel ..... C10J 3/485 165/157
2008/0115918 A1 5/2008 Kerber et al.
2008/0283230 A1 * 11/2008 Inatomi ..... F28D 7/0025 165/157
2009/0301130 A1 12/2009 Schonberger et al.
2010/0126705 A1 * 5/2010 Furui ..... F24D 11/0228 165/157
2011/0094719 A1 * 4/2011 Yang ..... F24J 3/082 165/157
2012/0261088 A1 * 10/2012 Steinbauer ..... F28F 27/02 165/11.1
2012/0261089 A1 * 10/2012 Steinbauer ..... F28D 7/0066 165/11.1

* cited by examiner

SPIRAL WOUND HEAT EXCHANGER SYSTEM WITH CENTRAL PIPE FEEDER

FIELD OF THE INVENTION

The invention relates to a heat exchanger system which comprises a jacket, extended along a longitudinal axis, which surrounds a jacket space. A pipe bundle is arranged in the jacket space, with a large number of pipes, which are wound around a central pipe that is extended along the longitudinal axis, i.e., a "spiral wound heat exchanger" or "coil-wound heat exchanger" (spiral wound heat exchangers, their production and their use are described in, for example, Hausen/Linde, Tieftemperaturtechnik, $2^{nd}$ Edition, 1985, pp. 471-475). The heat exchange system further includes at least one pre-distributor container that is arranged in the jacket space for accommodating and degassing a liquid-gas mixture, which is designed to coat a distributing means with the liquid degassed in the at least one pre-distributor container, whereby the distributing means is designed to load the pipe bundle with the liquid. In spiral heat exchangers with falling-film evaporation, the liquid in the jacket space that is added from above to the pipe bundle is preferably completely evaporated on the way downward in the direction toward the bottom of the jacket space.

A heat exchanger system of the above-mentioned type is known from, e.g., DE 102004040974A1 (WO2006/021315; US 2008/0115918; U.S. Pat. No. 8,087,454).

Since the liquid that is to be distributed is added as a two-phase mixture into the jacket space, the surface in the jacket space must then be prepared for an effective separation of the two phases. This can—in most cases triggered by high gas volume flows—lead to the necessity for an undesirable expansion of the jacket diameter or to an increase in the height of the device.

On this basis, an object of this invention is therefore to provide a heat exchanger, in which the above-mentioned expansion or increase in height can be eliminated.

Upon further study of the specification and appended claims, other objects, aspects and advantages of the invention will become apparent.

SUMMARY OF THE INVENTION

These objects are achieved by a heat exchanger system in which the jacket at the top of the heat exchanger system has an inlet aligned in particular with the longitudinal axis, in particular in the form of an inlet nozzle, which is in fluid connection with the central pipe, and that the central pipe has at least one lateral opening that empties into the at least one pre-distributor container so that the liquid-gas mixture can be fed via the inlet, the central pipe and the at least one lateral opening of the central pipe into the at least one pre-distributor container.

In other words, the two-phase flow on the jacket side according to the invention is thus fed centrally from above into the central pipe, whereby the jacket-side inlet flow is fed via the central pipe into the device and then flows laterally into the pre-distributor container or box for separation of gas and liquid, whereby to this end, the inside surface or the inside space of the central pipe can now also be used advantageously. Because of the increased effective surface that is available in this way for degassing the liquid that is to be distributed, an expansion and/or increase in the height of the heat exchanger can advantageously be omitted.

According to a preferred configuration of the invention, an end section of the central pipe is fixed on a tube plate, wherein the tube plate is provided at the top of the jacket and extends, in particular, in a direction perpendicular to the longitudinal axis. Preferably in the area of the top of the heat exchanger system the jacket extends away from a circumferential edge area of the tube plate, wherein the circumferential edge area of the tube plate is preferably welded to the jacket.

In addition, an end section of the inlet nozzle is preferably fixed to the tube plate on a side of the tube plate that faces away from the central pipe, and, in particular, end section of the inlet nozzle is welded to the tube plate.

According to a preferred embodiment of the invention, the central pipe has a cylindrical wall extended along the longitudinal axis, in which the at least one lateral opening of the central pipe is arranged.

Preferably, the at least one pre-distributor container originates from this cylindrical wall of the central pipe in the radial direction of the central pipe, and in this case preferably extends to an interior surface of the jacket that is opposite to the cylindrical wall or the central pipe. Thus, a side wall of the at least one pre-distributor container is preferably formed by the wall of the central pipe. In this side wall or the corresponding area of the wall of the central pipe, the at least one lateral opening assigned to this at least one pre-distributor container is provided, via which the liquid-gas mixture enters into the pre-distributor container. Preferably, the at least one pre-distributor container is designed in the shape of a pie slice.

According to a configuration of the invention, several pre-distributor containers are provided. In this case, each of the several pre-distributor containers originates perpendicular to the longitudinal axis from the wall of the central pipe, and preferably is designed as described above. In each case, between adjacent pre-distributor containers (which, in each case, are preferably configured in the shape of pie slices), preferably one gap is located, through which gas exiting from a pre-distributor container can flow downward into the jacket space. In addition, in particular the pipes of the pipe bundle are run through these gaps past the pre-distributor containers upward into the top of the heat exchanger system. In this case, the pipes of the pipe bundle are assembled on the upper end or the top of the heat exchanger in particular in pipe ropes, which run through the gaps between the pre-distributor containers, and are preferably fixed to the tube plate.

The gas flows down between the liquid distributor arms and is mixed in the area above the bundle with the liquid again. The flow inside the bundle is a 2-phase flow with a falling film evaporation. The 2-phase flow, or a vapor flow in case of full evaporation, exits the exchanger at the lower end of the jacket.

The at least one pre-distributor container or several pre-distributor containers in each case have an upper edge, from which the gas (or the gaseous phase), of the liquid-gas mixture that is to be degassed in the respective pre-distributor container, can flow downward into the jacket space. The upper edge of the respective pre-distributor container is preferably arranged above an upper edge of the lateral opening of the central pipe through which the liquid-gas mixture enters into the respective pre-distributor container.

Thus, in the at least one pre-distributor container, gas and liquid are separated. The liquid runs via at least one drain pipe, which originates from the bottom of the at least one pre-distributor container, into a distributing means lying below (also referred to as the main distributor). The gas flows upward, through a perforated disk arranged in at least one pre-distributor container, for evening it out and then further downward over the upper edge of at least one pre-distributor container. When liquid drops are entrained within the gas flow, the latter drop downward onto the respective perforated disk, and from there the liquid is in turn directed through at least one further drain pipe, which originates from the perforated disk and which preferably is aligned with the at least one drain pipe on the bottom of the respective pre-distributor container. Thus, the previously entrained liquid drop flow downward through the at least one further drain pipe into the respective pre-distributor container, and from there flow downward via the at least one drain pipe at the bottom of the respective pre-distributor container to the distributing means.

In addition, according to a preferred configuration of this invention, it is provided that the central pipe is closed in the downward direction at a point below the at least one lateral opening or below the existing openings by a bottom, so that the liquid-gas mixture cannot flow out downward through the central pipe. Preferably, the bottom is arranged along the longitudinal axis at the height of the bottom of the existing pre-distributor containers.

Ultimately, according to another advantageous configuration of this invention, it is provided that the at least one pre-distributor container is, or the several pre-distributor containers are, arranged in the jacket space at the top of the heat exchanger system.

Additional details and advantages of the invention are to be explained by the subsequent description of the figures of an embodiment based on the figures.

BRIEF DESCRIPTION OF THE DRAWINGS

The heat exchanger system according to the invention and further advantageous embodiments of the same will be described in more detail hereinafter with reference to the figures wherein:

In connection with FIG. 2, FIG. 1 shows a heat exchanger system 1 according to the invention, with a pressurized jacket 20 that in sections is shaped like a hollow cylinder, which extends downward starting from a top 2 of the heat exchanger system 1 or jacket 20 along a longitudinal axis or cylindrical axis L, which runs parallel to the vertical, relative to a state of the heat exchanger system 1 that is arranged as directed.

Figure 1:
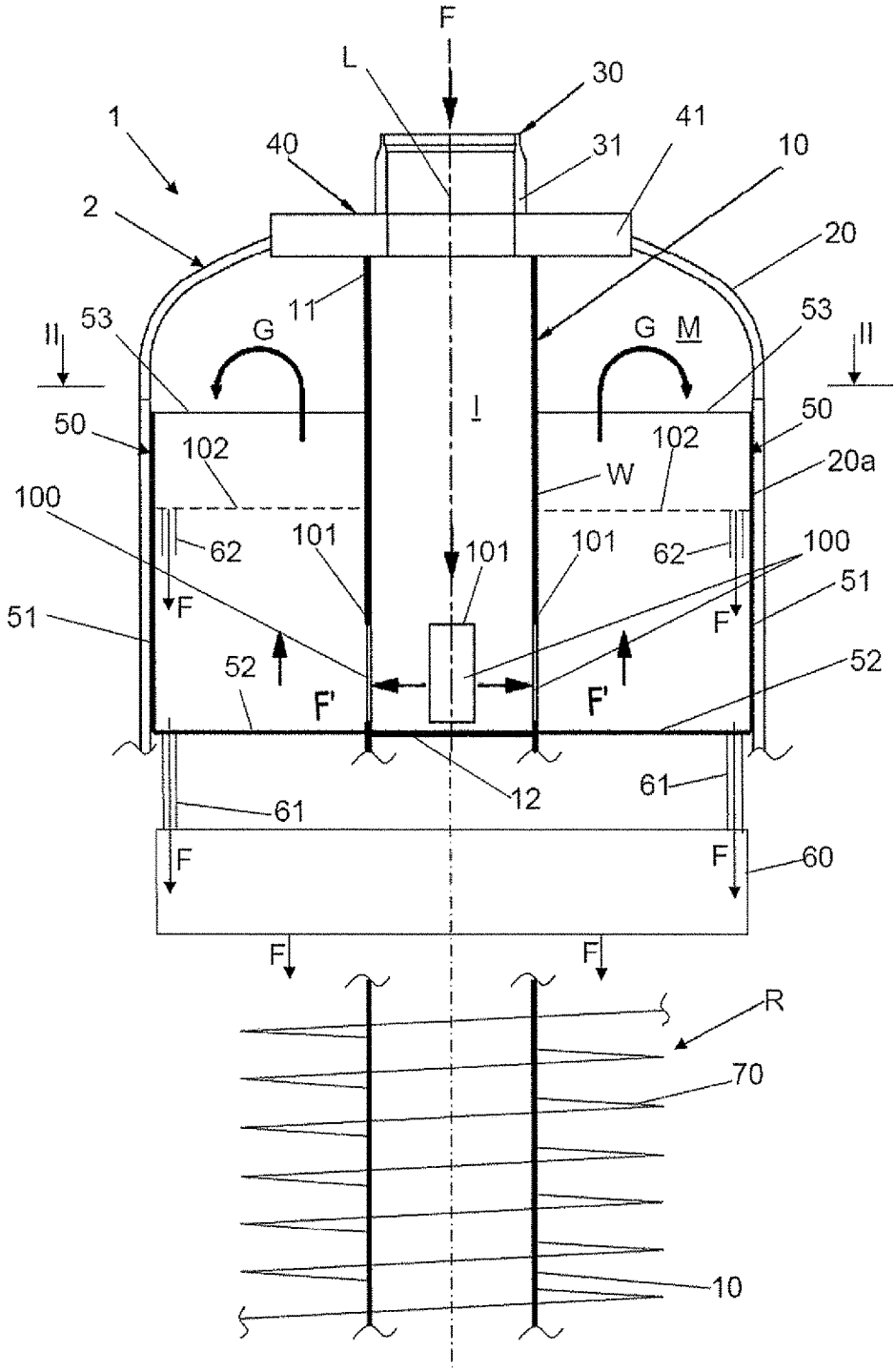
FIG. 1 shows a fragmentary, diagrammatic, sectional view of a heat exchanger system according to the invention.

The jacket 20 surrounds a jacket space M of the heat exchanger system 1, in which a pipe bundle R is arranged, which is formed from a large number of pipes 70, which are wound helically around a central pipe 10 in several layers, which central pipe 10 is arranged concentric to the jacket 20 in the jacket space M, and whose longitudinal axis coincides with the longitudinal axis L of the jacket 20. The pipe bundle R serves to accommodate a fluid medium, which is to enter into indirect heat exchange with a liquid F that is to be run into the jacket space M, which liquid is released from above to the pipe bundle R.

To this end, a distributing means 60 is arranged above the pipe bundle R, which is designed to distribute the liquid F to a cross-section of the jacket space M that runs perpendicular to the longitudinal axis L or to the vertical or to release the liquid F onto the pipe bundle R.

In this case, the distributing means 60 is coated with the liquid F from one or more pre-distributor containers 50, which liquid results from the degassing and calming of a two-phase liquid-gas mixture F', which is to be accommodated in one or more pre-distributor containers 50.

In this case, the liquid-gas mixture F' is introduced at the top 2 of the jacket 20 or the heat exchanger system 1 in an inlet nozzle 30, aligned with the longitudinal axis L or the central pipe 10, in the heat exchanger system 1. Inlet nozzle 30 is positioned at a distance away from a tube plate 40, provided on the top 2. The inlet nozzle 30 is fixed to the tube plate via an end section 31. The tube plate 40 is connected to the jacket 20 via its circumferential edge area 41. On a side of the tube plate 40 facing away from the inlet nozzle 30—namely in the jacket space M—the wall W of the central pipe 10 with an end section 11 is fixed to the tube plate 40 and thus is anchored relative to the jacket 20. In this case, the central pipe 10, or the inside space I of the central pipe 10 that is surrounded by the wall W, is in fluid connection with the inlet nozzle 30 (via a corresponding opening in the tube plate 40), so that the liquid-gas mixture F' that is introduced into the inlet nozzle 30 goes into the central pipe 10 or its inside space I and flows downward there. In this case, the liquid-gas mixture F' introduced into the inside space I strikes a closure or bottom 12 of the central pipe 10, that runs perpendicular to the longitudinal axis L, and is directed into the pre-distributor container 50 by lateral openings 100 in the wall W of the central pipe 10.

The pre-distributor containers 50 in each case extend, perpendicular to the longitudinal axis L, from a point starting from the wall W of the central pipe, i.e., in the radial direction of the central pipe 10, to the opposite interior surface 20*a* of the jacket 20 of the heat exchanger system 1. In this case, according to FIG. 2, the pre-distributor containers 50 are designed, in a cross-sectional plane running perpendicular to the longitudinal axis L, in the shape of pie slices, i.e., in the shape of circular sectors. Between two adjacent pre-distributor containers 50 a gap 104 extends in the radial direction of the jacket 20, through which, in each case, pipes 70 of the pipe bundle R run in direction of the longitudinal axis L past the pre-distributor containers 50 upward into the top 2 of the heat exchanger system 1. In each case, several pipes 70 are assembled at the ends of the pipes 70 to form a pipe rope, whereby such pipe ropes in the top 2 of the heat exchanger system 1 can be connected via the tube plate 40 to one assigned support each or laterally to the jacket 20 or tube plates with supports provided in the tube plate 40. The fixing of the pipes 70 in lateral tube plates has the drawback, however, that the pipes 70 must be bent radially outward. This would mean a higher production expense and thus longer manufacturing times. Moreover, a greater overall height would be necessary, which would lead to an increase in manufacturing costs. At the bottom or on the lower end of the heat exchanger system 1, the pipes 70 or pipe ropes formed therefrom are preferably also flow-connected to the supports provided on the jacket 20, so that fluid media can be introduced via the above-described supports into the pipe bundle R or can be drawn off from the pipe bundle R.

The liquid-gas mixture F' is accumulated, calmed, and degassed in the pre-distributor containers 50. The gaseous phase G can flow upward over an upper edge 53 of a side wall 51, originating from the bottom 52 of the respective pre-distributor container 50, in the jacket space M, and can flow downward through gaps 104. At the bottom 52 of the respective pre-distributor container 50, on a side, opposite to the opening 100 of the respective pre-distributor container 50, preferably two drain pipes 61 are provided, via which the degassed liquid F runs off into the distributing means 60.

Figure 2:
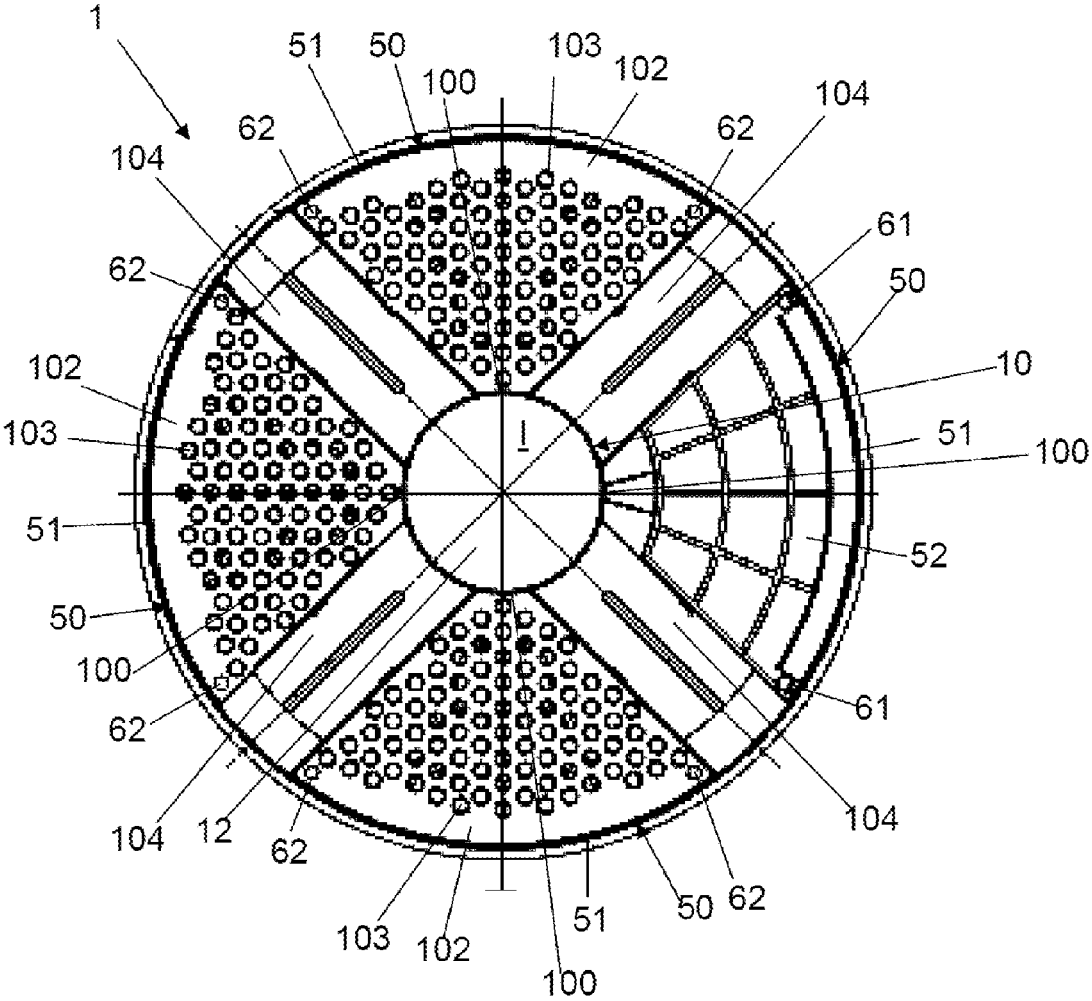
FIG. 2 shows a top view of the pre-distributor container of the heat exchanger system according to FIG. 1.

The upper edge 101 of the respective opening 100 in the wall W of the central pipe 10 is arranged along the longitudinal axis L below the upper edge 53 of the assigned pre-distributor container 50 as well as below a perforated disk 102, which extends into the respective pre-distributor container 50 via its cross-section and has a large number of holes 103. Gaseous phase G can flow through the holes 103 of the respective perforated disk 102 to even it out before gaseous phase G exits upward from the respective pre-distributor container 50. If liquid drops F are entrained by the gas flow, the latter can drop onto the respective perforated disk 102 and are in turn directed from there into the distributing means 60, namely via two drain pipes 62 in each of the respective perforated disk 102. In each case, a drain pipe 62 is aligned with an assigned drain pipe 61 that originates from the bottom 52 of the respective pre-distributor container 50. In FIG. 2, the pre-distributor container 50 that is on the right in the top view is shown without a corresponding perforated disk 102, so that the positions of the drain pipes 61 are visible on the bottom 52 of the pre-distributor container 50. This view also shows guide vanes for the 2-phase flow within the pre-distributor container 50.

The bottoms 52 of the individual pre-distributor containers 50 run perpendicular to the longitudinal axis L at the height of the bottom 12 of the central pipe 10.

Costly expansions of the top 2 of the spiral wound heat exchanger systems for separating gas and liquid can be avoided by the invention. Also, the overall height of the device can be reduced. In addition to the cost savings, this has the effect of shortening the pipe ropes. This facilitates manufacturing and in addition thus shortens the manufacturing time and reduces the costs of the device.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding European patent application EP 13003276.6, filed Jun. 27, 2013, are incorporated by reference herein.

| List of Reference Symbols | |
|---|---|
| 1 | Heat Exchanger System |
| 2 | Top |
| 10 | Central Pipe |
| 11 | End Section |
| 12 | Bottom |
| 20 | Jacket |
| 20a | Interior |
| 30 | Inlet Nozzle |
| 40 | Tube Plate |
| 41 | Edge Area |

-continued

| List of Reference Symbols | |
|---|---|
| 50 | Pre-Distributor Container |
| 51 | Side Wall |
| 52 | Bottom |
| 53 | Upper Edge |
| 60 | Distributing Means |
| 61, 62 | Drain Pipes |
| 70 | Pipe |
| 100 | Lateral Openings |
| 101 | Upper Edge |
| 102 | Perforated Disk |
| 103 | Holes |
| 104 | Gaps |
| F | Liquid |
| F' | Liquid-Gas Mixture |
| G | Gas |
| I | Inside Space |
| L | Longitudinal Axis |
| M | Jacket Space |
| R | Pipe Bundle |

The invention claimed is:

1. A heat exchanger system comprising:

a jacket that extends along a longitudinal axis (L) and surrounds a jacket space (M) of the heat exchanger system (1), a pipe bundle (R) arranged within the jacket space (M) comprising a plurality of pipes (70) that are wound helically around a central pipe (10), wherein said central pipe (10) extends along said longitudinal axis (L), at least one pre-distributor container (50) arranged within said jacket space (M) for accommodating and degassing a liquid-gas mixture (F'), said at least one pre-distributor container (50) is designed to degas liquid (F) from a liquid-gas mixture (F') and to distribute liquid (F) into a main distributor (60) for distributing liquid (F) onto said pipe bundle (R), an inlet (30) in the jacket (20) at the top (2) of the heat exchanger system (1) wherein said inlet is aligned with said longitudinal axis (L) and is in the form of an inlet nozzle (30), and wherein said inlet (30) is in fluid connection with said central pipe (10), said central pipe (10) has at least one lateral opening (100) that opens into the at least one pre-distributor container (50) whereby the liquid-gas mixture (F') is capable of flowing via said inlet (30), said central pipe (10), and said at least one lateral opening (100) into said at least one pre-distributor container (50).

2. The heat exchanger system according to claim 1, wherein said central pipe (10) has an end section (11) which is fixed on a tube plate (40) extending in a direction perpendicular to said longitudinal axis (L), wherein said tube plate (40) is provided at the top (2) of the heat exchanger system (1).

3. The heat exchanger system according to claim 2, wherein said tube plate (40) is connected at a circumferential edge area (41) thereof to said jacket (20).

4. The heat exchanger system according to claim 1, wherein said inlet nozzle (30) has an end section (31) which is fixed on a side of a tube plate (40) that faces away from said central pipe (10).

5. The heat exchanger system according to claim 1, wherein said central pipe (10) has a cylindrical wall (W) in which there is said at least one lateral opening (100).

6. The heat exchanger system according to claim 5, wherein said at least one pre-distributor container (50)

originates from said cylindrical wall (W) and extends to an interior surface (20*a*) of said jacket (20).

7. The heat exchanger system according to claim 1, wherein said at least one pre-distributor container (50) has an upper edge (53), via which a gaseous phase (G) of the liquid-gas mixture (F') can flow downward into said jacket space (M), and said central pipe (10) has a cylindrical wall (W) in which there is said at least one lateral opening (100), wherein said upper edge (53) of said at least one pre-distributor container (50) is arranged above an upper edge (101) of said at least one lateral opening (100) of said central pipe (10).

8. The heat exchanger system according to claim 1, wherein said at least one pre-distributor container (50) is flow-connected to said main distributor (60) via at least one drain pipe (61) whereby degassed liquid (F) can flow from said at least one pre-distributor container (50) to said main distributor (60).

9. The heat exchanger system according to claim 1, wherein a perforated disk (102) is arranged in the at least one pre-distributor container (50), and said central pipe (10) has a cylindrical wall (W) in which there is said at least one lateral opening (100), wherein perforated disk (102) is positioned above said at least one lateral opening (100), so that a gaseous phase (G) of the liquid-gas mixture (F') can flow upward through said perforated disk (102), and wherein said perforated disk (102) is flow-connected to said main distributor (60) via at least one drain pipe (62) in said perforated disk (102) and at least one drain pipe (61) on the bottom (52) of the at least one pre-distributor container (50) which is aligned with via at least one drain pipe (62) in said perforated disk (102), whereby liquid (F) that is entrained by gaseous phase (G) and that drops onto said perforated disk (102), is capable of being introduced via said at least one drain pipe (62) of said perforated disk (102) into said at least one pre-distributor container (50) and then, via said at least one drain pipe (61) on the bottom (52) of said at least one pre-distributor container (50), into said main distributor (60).

10. The heat exchanger system according to claim 1, wherein said central pipe (10) has a cylindrical wall (W) in which there is said at least one lateral opening (100), and said central pipe (10) is closed downward below said at least one lateral opening (100), by a bottom (12), which is arranged along the longitudinal axis (L), at the height of a bottom (52) of said at least one pre-distributor container (50).

11. The heat exchanger system according to claim 1, wherein said at least one pre-distributor container (50) is arranged at the top (2) of the heat exchanger system (1).

12. The heat exchanger system according to claim 1, wherein said system comprises a plurality of said pre-distributor containers (50) at the same height along said longitudinal axis, and wherein each of said pre-distributor containers (50) is in the shape of a pie slice.

13. The heat exchanger system according to claim 1, wherein between two adjacent pre-distributor containers (50), a gap (104) extends in the radial direction of the jacket (20), through which, in each case, pipes (70) of the pipe bundle (R) run in direction of the longitudinal axis (L) past said pre-distributor containers (50) upward into the top (2) of the heat exchanger system (1).

14. The heat exchanger according to claim 9, said wherein perforated disk (102) extends over the entire pre-distributor container cross-section.

15. A heat exchanger system comprising:

a jacket that extends along a longitudinal axis (L) and surrounds a jacket space (M) of the heat exchanger system (1), a pipe bundle (R) arranged within the jacket space (M) comprising a plurality of pipes (70) that are wound helically around a central pipe (10), wherein said central pipe (10) extends along said longitudinal axis (L), at least one pre-distributor container (50) arranged within said jacket space (M) for accommodating and degassing a liquid-gas mixture (F'), said at least one pre-distributor container (50) is designed to degas liquid (F) from a liquid-gas mixture (F') and to distribute liquid (F) into a main distributor (60) for distributing liquid (F) onto said pipe bundle (R), an inlet (30) in the jacket (20) at the top (2) of the heat exchanger system (1) wherein said inlet is aligned with said longitudinal axis (L) and is in the form of an inlet nozzle (30), and wherein said inlet (30) is in fluid connection with said central pipe (10), said central pipe (10) has at least one lateral opening (100) that opens into the at least one pre-distributor container (50) whereby the liquid-gas mixture (F') is capable of flowing via said inlet (30), said central pipe (10), and said at least one lateral opening (100) into said at least one pre-distributor container (50), wherein said system comprises a plurality of said pre-distributor containers (50) at the same height along said longitudinal axis, and wherein each of said pre-distributor containers (50) is in the shape of a pie slice.

16. The heat exchanger system according to claim 15, wherein between two adjacent pre-distributor containers (50), a gap (104) extends in the radial direction of the jacket (20), through which, in each case, pipes (70) of the pipe bundle (R) run in direction of the longitudinal axis (L) past said pre-distributor containers (50) upward into the top (2) of the heat exchanger system (1).

17. The heat exchanger system according to claim 15, wherein said central pipe (10) has an end section (11) which is fixed on a tube plate (40) extending in a direction perpendicular to said longitudinal axis (L), wherein said tube plate (40) is provided at the top (2) of the heat exchanger system (1).

18. The heat exchanger system according to claim 17, wherein said tube plate (40) is connected at a circumferential edge area (41) thereof to said jacket (20).

19. The heat exchanger system according to claim 1, wherein each of said pre-distributor containers (50) is flow-connected to said main distributor (60) via at least one drain pipe (61) whereby degassed liquid (F) can flow from said at least one pre-distributor container (50) to said main distributor (60).

* * * * *